US006671968B2

(12) United States Patent
Shannon

(10) Patent No.: US 6,671,968 B2
(45) Date of Patent: Jan. 6, 2004

(54) TOOL FOR FORMING IN SITU DECORATIVE PATTERNS IN A FLOOR COVERING AND METHOD OF FORMING PATTERNS

(76) Inventor: Stephen Shannon, 359 Linden Ct., Herndon, VA (US) 20170

( * ) Notice: Subject to any disclaimer, the term of this patent is extended or adjusted under 35 U.S.C. 154(b) by 55 days.

(21) Appl. No.: 10/058,139

(22) Filed: Jan. 29, 2002

(65) Prior Publication Data

US 2003/0140504 A1 Jul. 31, 2003

(51) Int. Cl.[7] ..... B26B 29/00
(52) U.S. Cl. ..... 30/294; 30/289
(58) Field of Search ..... 30/278, 280, 286, 30/289, 293, 294; 33/27.12, 527

(56) References Cited

U.S. PATENT DOCUMENTS

| | | | | | |
|---|---|---|---|---|---|
| 1,907,738 | A | | 5/1933 | Christman | |
| 2,217,998 | A | | 10/1940 | Buttress | |
| 2,243,778 | A | | 5/1941 | Stansel | |
| 2,296,232 | A | | 9/1942 | Drain | |
| 2,490,119 | A | | 12/1949 | Edinger | |
| 2,600,728 | A | | 6/1952 | Bernard | |
| 2,790,245 | A | | 4/1957 | Wilkes | |
| 3,266,160 | A | | 8/1966 | Toien | |
| 3,768,347 | A | | 10/1973 | Wade et al. | |
| 3,934,342 | A | | 1/1976 | Matsushita | |
| 4,057,898 | A | | 11/1977 | Piosky | |
| 4,064,627 | A | | 12/1977 | Zanfini | |
| 4,148,142 | A | * | 4/1979 | Sullivan et al. | 30/293 |
| 4,194,543 | A | | 3/1980 | Cotton | |
| 4,330,939 | A | | 5/1982 | Robinson | |
| 4,443,942 | A | | 4/1984 | Demeter | |
| 4,502,232 | A | | 3/1985 | Broders | |
| 4,539,757 | A | | 9/1985 | Shyu | |
| 4,606,124 | A | * | 8/1986 | Figueroa | 30/293 |
| 4,648,181 | A | | 3/1987 | Fortin | |
| 4,656,901 | A | | 4/1987 | Axford et al. | |
| 4,793,033 | A | | 12/1988 | Schneider et al. | |
| 4,833,956 | A | | 5/1989 | Roberts | |
| 4,844,757 | A | | 7/1989 | Nagata et al. | |
| 4,949,462 | A | * | 8/1990 | Spencer | 30/293 |
| 5,044,081 | A | * | 9/1991 | Nguyen | 30/294 |
| 5,159,758 | A | * | 11/1992 | MacDonald | 30/294 |
| 5,188,013 | A | | 2/1993 | Cardinale | |
| 5,353,508 | A | | 10/1994 | Baker | |
| 5,404,778 | A | * | 4/1995 | Ward | 30/289 |
| 5,485,676 | A | | 1/1996 | Terhorst | |
| 5,788,561 | A | | 8/1998 | Pearlman et al. | |
| 5,946,808 | A | | 9/1999 | Martinez | |
| 6,044,570 | A | | 4/2000 | Nochowitz | |
| 6,112,417 | A | | 9/2000 | Hyer et al. | |
| 6,226,878 | B1 | | 5/2001 | Shannon | |
| 6,230,410 | B1 | | 5/2001 | Taylor et al. | |
| 6,308,422 | B1 | | 10/2001 | MacDonald | |

* cited by examiner

*Primary Examiner*—Hwei-Siu Payer
(74) *Attorney, Agent, or Firm*—Miles & Stockbridge P.C.; Edward J. Kondracki

(57) ABSTRACT

A cutting tool and method for applying decorative patterns to floor coverings. The tool comprises a force applying body member having a slide member secure to the bottom of the body member. A knife edge secured by the slide member extends outwardly from the slide member and is used for marking or cutting an underlying floor covering. The slide member has a longitudinal channel adapted to receive the edge of a section of floor covering previously cut in a predetermined pattern and which serves as a template in order to cut the pattern into the underlying floor covering. As downward and forward pressure is applied to the body member, the apparatus is advanced along the edge of the pattern and a cut is made by the tool into the underlying floor covering at a dimension equal to the edge of the pattern. The cut pattern is removed and mated with the floor covering from which the template was cut. Likewise the template may be mated with the section of floor covering from which the pattern was removed. By using floor coverings of different color, contrasting decorative patterns are achieved.

9 Claims, 5 Drawing Sheets

TOOL FOR FORMING IN SITU DECORATIVE PATTERNS IN A FLOOR COVERING AND METHOD OF FORMING PATTERNS

FIELD OF THE INVENTION

The present invention generally relates to the field of floor coverings and more particularly to a tool for forming a decorative pattern in a floor covering and a method for forming the pattern in the floor covering in situ.

BACKGROUND OF THE INVENTION

Interior designers and architects often require the installation of decorative floor coverings in commercial and residential buildings. Furthermore, homeowners often prefer a decorative floor covering to a more traditional floor covering in a home. The decorative patterns of floor coverings frequently vary from installation to installation in order to complement the decor of the space. For instance, the color and patterns of wall coverings, the layout of the room, the type of furniture, etc. may influence the design of the floor covering. Further, organizations and corporations may enjoy company logos patterned into the floor covering of a building lobby or other area. To achieve these custom designs required by the flooring industry, decorative floor coverings are formed by cutting shapes from one piece of floor covering and inserting a corresponding shape of another color or pattern of floor covering. Two known methods prevalent in the flooring industry for cutting decorative pieces for assimilation into a pattern require either extremely high craftsmanship or complicated site machinery. One known method requires the use of a top knife such as a Roberts top knife to free form a pattern into a carpet floor covering. Pattern designs requiring high quality and extensive marks or cuts by such knives require tedious and meticulous attention to the job and high craftsmanship to produce cuts at an acceptable level. Even under the skill of a highly trained artisan, the finished decorative pattern is often sloppy and of inadequate quality. The labor cost of a highly skilled artisan, coupled with the time and patience of using a top knife are undesirable disadvantages of present methods for forming patterns. The second existing method for marking or cutting decorative patterns into floor coverings employs Computer Aided Design (CAD) software and an electric cutting machine. The cutting machine makes exact and precise cuts in the floor covering per the CAD software's instructions. However, due to the generally large nature of these machines, marks and cuts must be performed off the job-site and therefore prohibits on-site modifications of the design during the installation process. The machines are expensive and the added costs and time associated with shipping the finished materials to the job site add undesirable overhead to the finished project.

SUMMARY OF THE INVENTION

An object of the present invention is to provide a method and tool for minimizing the above-identified drawbacks and disadvantages experienced in connection with cutting complex, decorative patterns into floor coverings and assimilation into a final pattern.

Another object of the present invention is to provide a tool and method for minimizing costly overhead in connection with cutting complex, decorative patterns into floor coverings and assimilation into a final pattern.

Yet another object of the present invention is to provide a tool and method for minimizing the craftsmanship and training required to apply complex, decorative patterns into floor coverings.

Still another object of the present invention is to provide a tool and method for cutting complex, decorative patterns into floor coverings and assimilation into a final pattern in an expeditious manner.

Still yet another object of the present invention is to provide a tool and method for cutting complex, decorative patterns into floor coverings with great precision.

In accordance with one embodiment of the invention, there is provided a tool having a slide member affixed to an underside of a body member. The slide member comprises a foot and a guide, the guide having a channel extending the length therein for receiving the edge of a first section of floor covering that is cut to a predetermined shape. A marking implement or knife blade is secured between the guide and foot at an angle that maximizes the marking or cutting efficiency.

In accordance with a preferred method of operation, the channel of the guide member is adapted, in operation, to receive an edge of a first section of floor covering which has been pre-cut to form a distinctive pattern and which overlies a second section of floor covering in which the pattern is to be formed. The bottom surface of the foot and guide rest on the underlying section of floor covering that is to be marked or to receive a cut. The operator applies forward and downward pressure to the body, advancing the apparatus along the edge of the first section of floor covering that acts as a template while the marking implement cuts the second section of floor covering at an equivalent dimension.

DETAILED DESCRIPTION OF THE INVENTION

Figure 1:
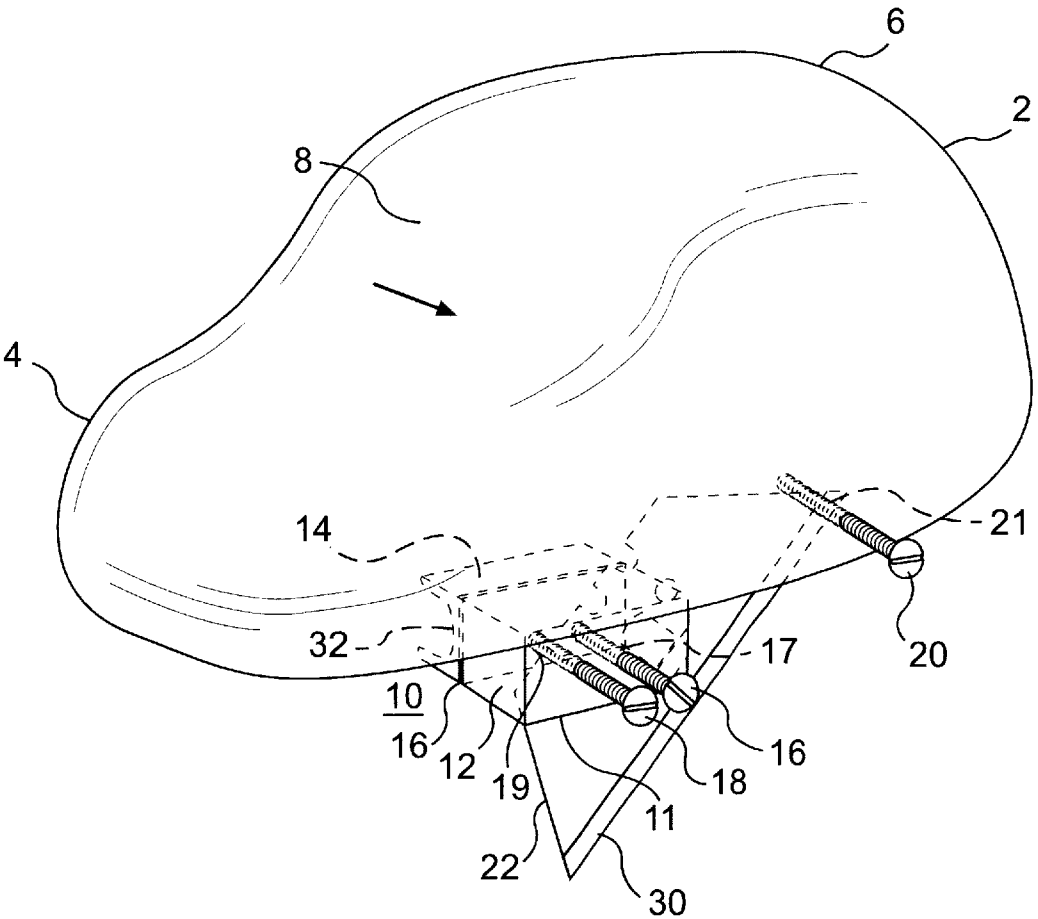
FIG. 1 is a perspective view of the marking or cutting tool.

Referring to FIG. 1, the present invention comprises a body member 2 with an ergonomic design having a depression 4 at one end of body member 2 and a rise 6 at the other end. Slope 8 spans the body member 2 between depression 4 and rise 6. In accordance with a preferred method of operation, depression 4 receives the heel of a hand while the palm lay on slope 8 and the fingers extend to grasp over the top of and around rise 6. The ergonomic design of body member 2 concentrates the pressure applied by the palm of the hand downward and towards rise 6 as indicated by the arrow in FIG. 1. The design of body member 2 thus positions the pressure so as to minimize the effort required by the operator to accomplish the desired result. Body member 2 may be composed of metal, hard plastic, or other material sufficient for receiving the pressure applied by the palm of the operator. A grip pad, cushion, or handle may be fit to the top of body member 2 for increased comfort. Body member 2 may embody other shapes as well in alternative embodiments.

Affixed to the bottom of body member 2 is a slide member 10 which may be affixed by a weld seam or other suitable manner at a position that maintains the balance of body member 2 when in operation. The slide member has an underside 11 which preferably is a low friction surface and may be coated with a suitable lubricant to enhance its gliding and sliding ability.

The slide member 10 comprises a foot 12 and a guide 14. Foot 12 and guide 14 are separated by a gap 16, best viewed in FIG. 2, defined by a face 24 of guide 14 and a face 26 of foot 12, to assume parallel, lengthwise positions. Gap 16 is preferably about ⅛ in. wide.

Figure 2:
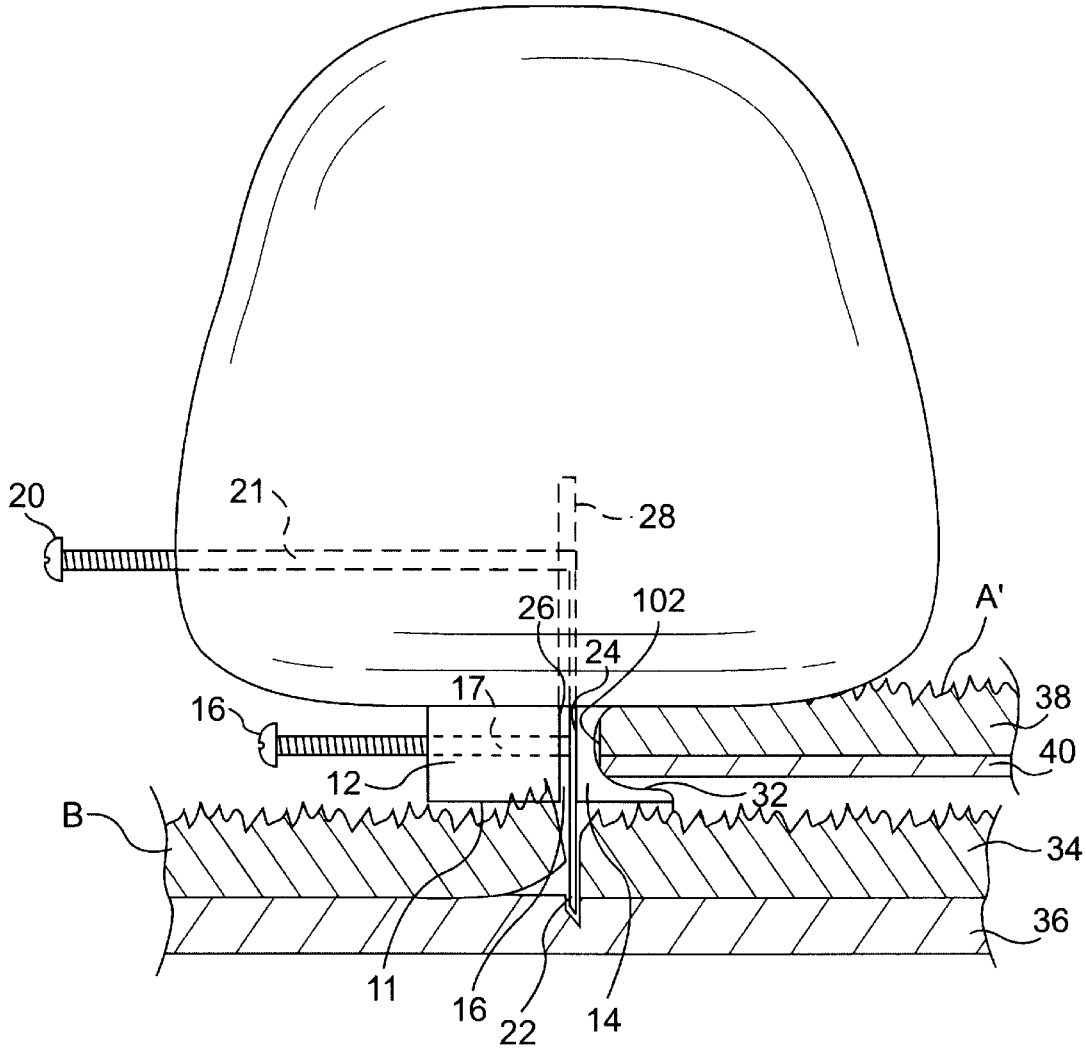
FIG. 2 is a front, profile view of the tool during operation.

With reference to FIG. 2, the apparatus is shown cutting a decorative pattern into a floor covering. As depicted in this figure, the floor covering is a carpet material. The flat, bottom surface of foot 12 as well as guide 14 rests on carpet B to provide a level cut. The bottom surface of foot 12 and guide 14 may have a small coefficient of friction to allow the cutting tool to slide easily along the top of carpet B as the cutter is advanced the length of carpet A'. Bolts 16, 18 threaded in threaded opening 17, 19, respectively, in combination with bolt 20 threaded into threaded opening 21 of body member 2, secure a marking or cutting implement 22 in gap 16 disposed between guide 14 and foot 12. Implement 22 is set by bolts 16, 18, 20 so that one end extends upward into a channel 28 in the bottom of body member 2 and while an opposite end extends outward from the bottom surfaces of guide 14 and foot 12. Bolt 16 is threaded through a threaded opening 17 in foot 12, passes through gap 16 and the top of implement 22, and is tightened against face 24 of guide 14 to suspend implement 22 in gap 16. Bolt 18 is threaded through threaded opening 19 of foot 12 and passes through gap 16 and above the top of implement 22 and is tightened against face 24 of guide 14. Likewise, bolt 20 is threaded through threaded opening 21 in body member 2 and passes above the top of implement 22. Bolt 20 prevents the implement 22 from pivoting counter clockwise on bolt 16 while bolt 18 prevents the implement 22 from pivoting clockwise. In the configuration illustrated, implement 22 is set to an angle that minimizes the effort required by the operator to accomplish the desired cutting result. The combination of bolts 18, 20 set implement 22 at an angle allowing a sharp edge 30 of the marking implement 22 to smoothly and easily mark or cut carpet B. In an alternative embodiment, bolt 20 and threaded opening 21 may be absent and functionally replaced by a barrier or shoulder unitary to body member 2 that restricts pivoting of implement 22.

Guide 14 has a longitudinal channel 32 at one side of guide 14 that extends the length of the guide 14 and parallel of carpet B for receiving an edge 102 of a carpet section A' comprising tufts 38 and backing 40, as shown in FIG. 2, which functions as a template or guide corresponding to the desired pattern. During the preferred method of operation, channel 32 receives edge 102 of section A' and traces the edge 102 onto carpet B, either marking or cutting carpet B to an exact dimension. Channel 32 may be semicircular with a ¼ in. diameter but may vary in alternative embodiments according to the size and shape of section A'. The length of foot 12 and guide 14 is advantageously very short and may vary from approximately ¼ in. to 1½. The length is dependent on the shape or curve of the design to be cut. For example, if the design contains tight curves then the length is shortened to its smaller dimension to allow the operator to pivot the body member 2 on the bottom of slide member 10 to sufficiently follow the curved edge 102 of carpet A'. Likewise, if the design contains obtuse curves or linear shapes then the length may be increased to provide a smoother mark or cut along carpet B.

In an alternative embodiment, foot 12 may be absent from slide member 10 with marking implement 22 passing only through channel 28 of body member 2 and fully secured therein. In such an embodiment, guide 14 may be repositioned under body member 2 or body member 2 may embody an alternative shape to maintain the balance of the apparatus during operation.

Figure 3A:
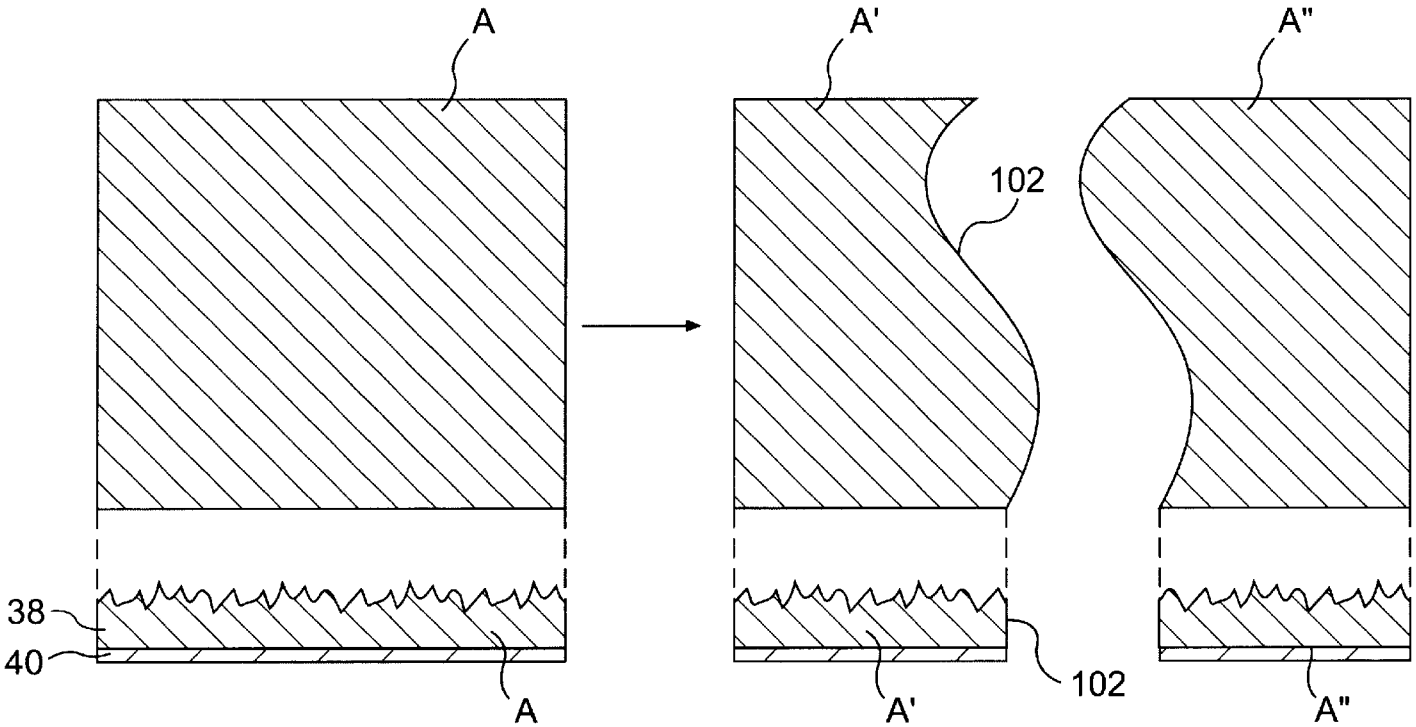
FIG. 3, comprising views 3A, 3B, 3C, and 3D illustrates the various steps or stages of the method by which a decorative pattern is formed in a carpet floor covering.

The present invention is particularly well suited to applying decorative patterns to a carpet. The following method of operation is described in the context of applying a decorative pattern to a tufted carpet with reference made to FIGS. 2 and 3, with FIGS. 3A–3C referring to a section of a complete pattern shown in FIG. 3D. However, it will be appreciated that the present invention may be used to apply patterns to other floor coverings, including but not limited to linoleum and vinyl. Appropriate adjustments may be made to the type and arrangement of marking implement 22, as well as to the bottom surface of foot 12 and guide 14 for various floor coverings. For example, a roller may be affixed to the bottom surface of slide member 10 or extend from foot 12 and guide 14 to facilitate movement of the tool on a flat linoleum or vinyl floor covering.

A predetermined pattern is cut into a first carpet A using the method and apparatus as described in U.S. Pat. No. 6,226,878, the subject matter of which is herein incorporated by reference. Carpet A is cut into a first section A' and a second section A" shown in FIG. 3A. Section A" in the present embodiment, is set aside. The cut forms an edge 102 which defines the edge of a template that is also incorporated into the final floor covering.

Figure 3B:
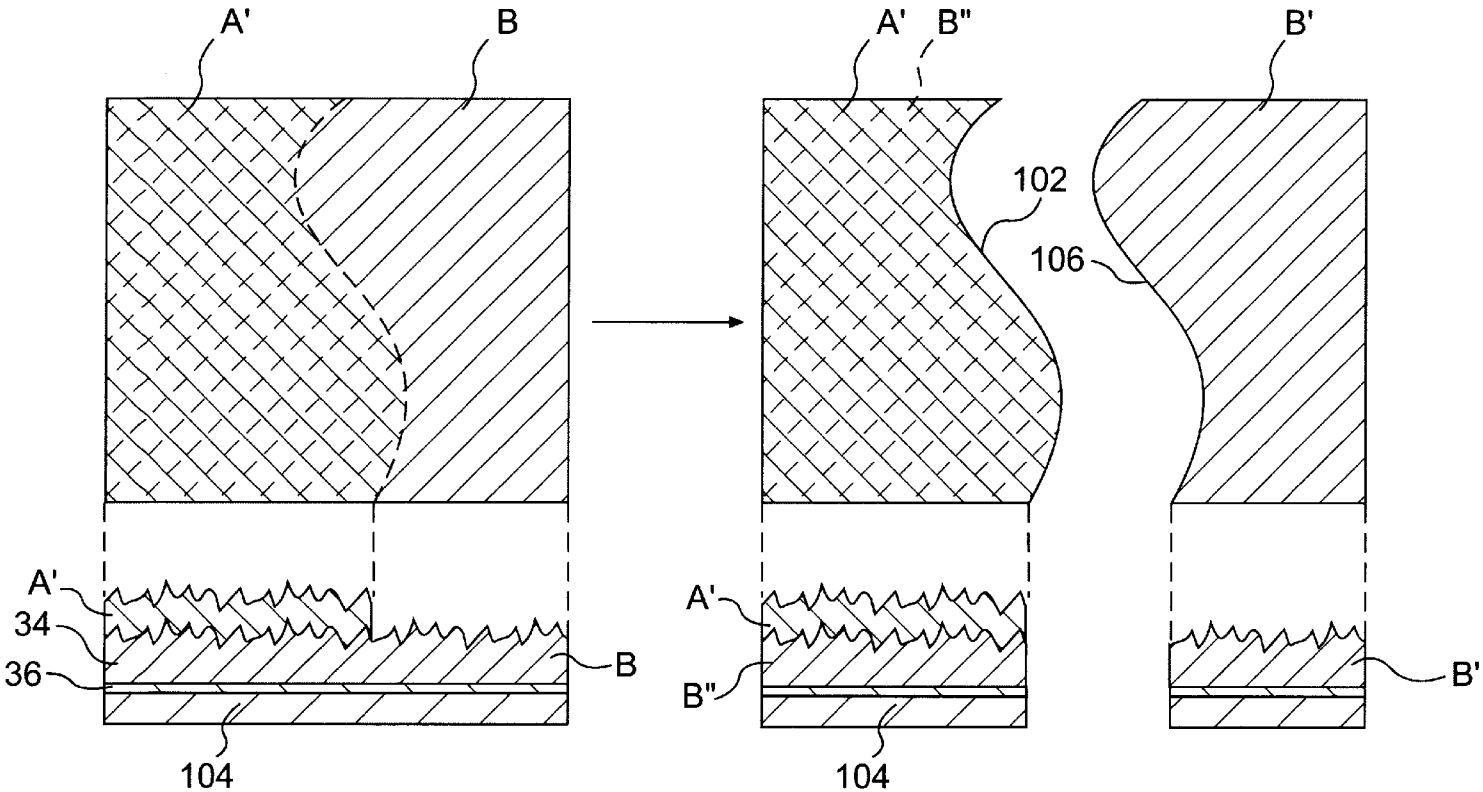

FIG. 3B shows a second carpet B placed on a floor that is to be covered with carpet. Section A' is placed over carpet B at a location where the pattern is to be formed. As a result, section A' acts as an overlay and carpet B acts as an underlay.

Referring back to FIG. 2, edge 102 of section A' is placed into groove 32 of guide 14 of the present invention. Downward and forward pressure is applied to body member 2 to cause marking implement 22 to cut through pile 34 and into backing 36 of carpet B. Under wood floor conditions, implement 22 may be raised by adjusting bolts 16, 18, 20 to only partially cut, or score, through backing 36 of carpet B as shown in FIG. 2, and may be completed with a conventional top knife. Thereby, an undesirable mark in the wood floor 303 would be avoided. Conversely, where the carpet is laid on a concrete floor, implement 22 may be lowered to fully cut through backing 36 of carpet B. Once the depth of implement 22 is set to a desirable level, pressure is applied by the operator on body member 2 and the tool is advanced along edge 102 of section A' and the length thereof. Channel 32 holds edge 102 of section A' as the tool is advanced to cut a pattern in carpet B corresponding to that of section A'.

Figure 3D:
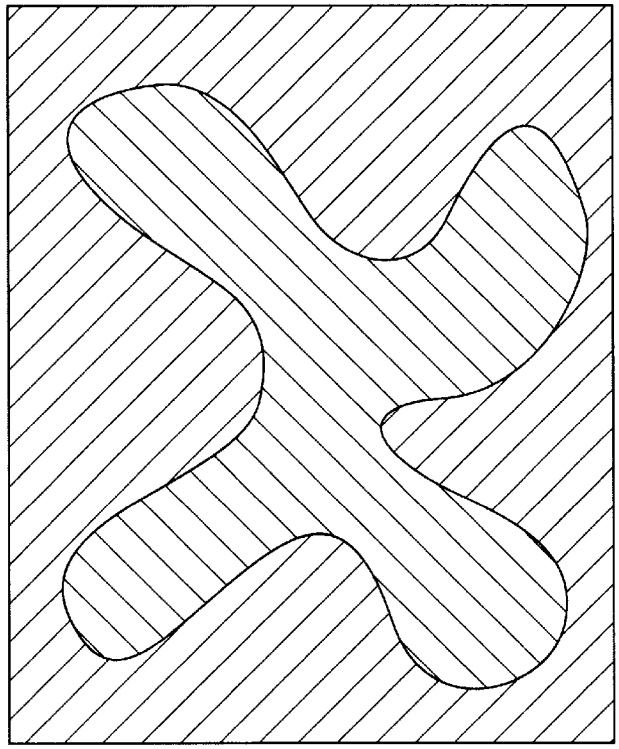
Figure 3C:
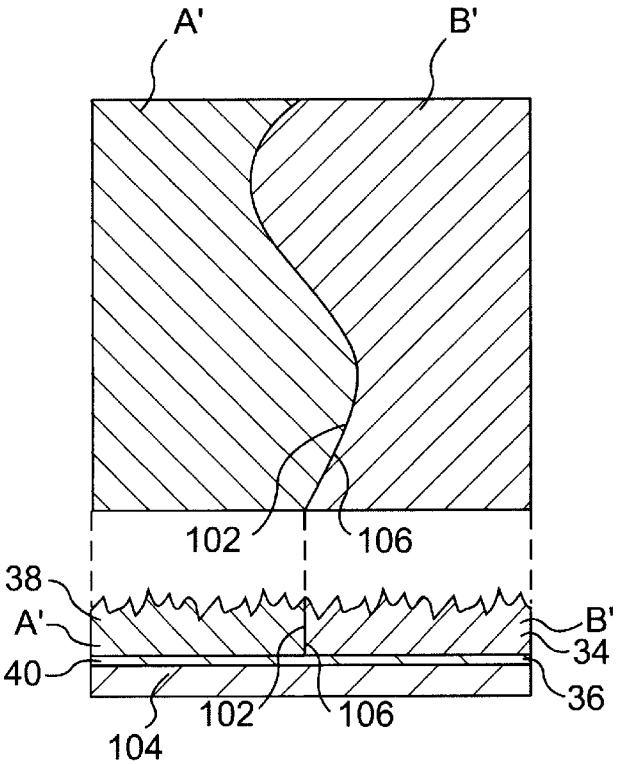

Referring to FIG. 3B, it will be seen that in accordance with the present invention, carpet B is cut into a first section B' with an edge 106 and a second section B". Section B" is removed and section B' is mated with section A' by placing section A' flush on the floor 104 and in the same horizontal plane as section B' as shown in FIG. 3C. With edge 102 of section A' and edge 106 of section B' abutting, a carpet seam tape may be applied to the seam joint and adhered thereto using a carpet iron so as to close or seal the seam or joint between section A' and section B'. Other suitable carpet joining methods may be applied. It will be appreciated that section B" may now be mated with section A" previously set aside to form a reversed pattern from that of section A' and B'. The same carpet joining methods may be used to seal the joints. FIG. 3D illustrates a completed pattern. The completed pattern of FIG. 3D is of a very simplistic nature for illustration purposes and it will be appreciated by one skilled in the art that complex designs may be formed.

While the preferred method of operation has been described with section A' being chosen from the floor covering material to be incorporated into the design, it will be appreciated by those skilled in the art that any material suitable for functioning as an edge of a pattern and that can be received in channel 32 of the tool may be utilized so that sections of different materials can be used to develop patterns of varying color and texture limited only be the creativity of the designer and compatibility of the materials.

While this invention has been described in conjunction with specific embodiments thereof, it is evident that many alternatives, modifications and variations will be apparent to those skilled in the art. Accordingly, the preferred embodiments of the invention as set forth herein, are intended to be illustrative, not limiting. Various changes may be made without departing from the true spirit and full scope of the invention as set forth herein and defined in the claims.

I claim:

1. A cutting tool comprising, a body member having a top force receiving surface and an underface, a slide member affixed to the underface, the slide member having a first part and a second part spaced from the first part, a knife edge having a first end and a second end secured between the first part and the second part, the first end extending outward from a bottom surface of the slide member, and the second part having a longitudinal channel adapted to receive an edge of a first section of floor covering material which serves as a template for cutting a pattern into a second section of floor covering disposed beneath the first section.

2. The cutting tool of claim 1 wherein the body member includes a channel for receiving the second end of the knife edge and a restriction within the body member to restrict the knife edge from pivoting as the cutting tool is advanced over the floor covering.

3. The cutting tool of claim 1 wherein the body member is ergonomically shaped to receive the palm of a user for which a force is applied for cutting the floor covering.

4. The cutting tool of claim 1 wherein the longitudinal dimension of the first and second parts of the slide member are between ¼ in. to 1½ in.

5. The cutting tool of claim 1 wherein the slide member has a flat underside.

6. The cutting tool of claim 1 wherein the slide member has a low friction underside surface.

7. The cutting tool of claim 6 wherein the slide member has an underside coated with a lubricant.

8. A cutting tool comprising:

a body member having a top force receiving surface and an underface, a slide member affixed to the underface, a marking implement extending below the slide member and secured between first and second spaced apart parts of the slide member and the slide member having a longitudinal channel adapted to receive an edge of a first section of floor covering material which serves as a template to enable marking of a pattern by the marking implement in a second section of floor covering disposed beneath the first section.

9. A cutting tool comprising a body member having a top force receiving surface and an underface, a slide member affixed to the underface, a marking implement extending below the slide member, the slide member having a longitudinal channel adapted to receive an edge of a first section of floor covering material which serves as a template to enable marking of a pattern by the marking implement in a second section of floor covering disposed beneath the first section, and the body member having a channel for receiving the marking implement.

* * * * *